United States Patent [19]

Kirk

[11] 4,357,894

[45] Nov. 9, 1982

[54] CANOE SEAT CONSTRUCTION

[76] Inventor: Johnny Kirk, Rte. 1, Box 312, Hinton, W. Va. 25951

[21] Appl. No.: 186,132

[22] Filed: Sep. 11, 1980

[51] Int. Cl.[3] ..... B63B 17/00

[52] U.S. Cl. ..... 114/347; 114/363

[58] Field of Search ..... 9/1.4, 7; 297/250, 252, 297/314; 248/424, 429; 108/143; D12/302; 114/347, 363, 364

[56] References Cited

U.S. PATENT DOCUMENTS 2,483,552 10/1949 Lincoln ..... 9/7
2,815,517 12/1957 Andresen ..... 9/7
3,665,532 5/1972 Simpson ..... 9/1.4
3,718,365 2/1973 Gibson ..... 9/7
3,982,293 9/1976 Lagervall ..... 9/7

*Primary Examiner*—Trygve M. Blix
*Assistant Examiner*—Stephen P. Avila
*Attorney, Agent, or Firm*—Oblon, Fisher, Spivak, McClelland & Maier

[57] ABSTRACT

A canoe seat construction for achieving optimum weight distribution in the canoe to improve planing of the canoe on the water and to position the paddler for most efficient paddling, includes a subframe releasably attached to the gunwales of the canoe, a seat frame carried by the subframe for movement transversely of the canoe and a seat carried by the seat frame for movement longitudinally of the canoe.

8 Claims, 17 Drawing Figures

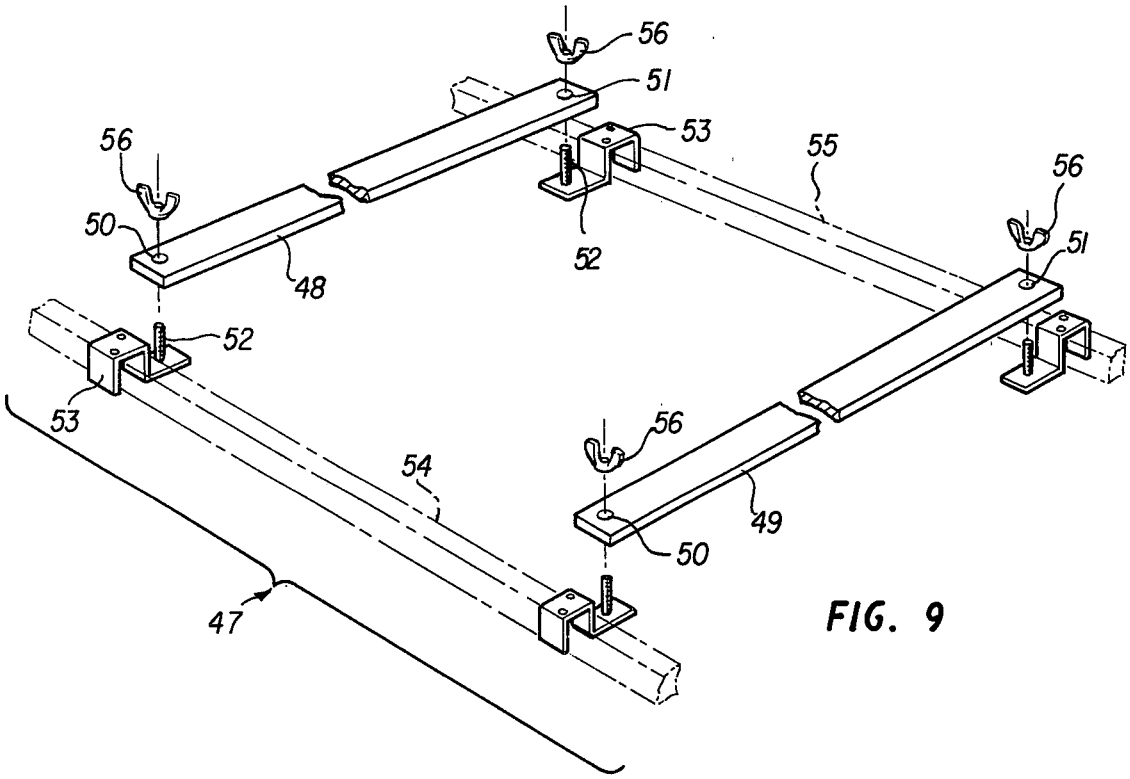
FIG. 9
FIG. 10
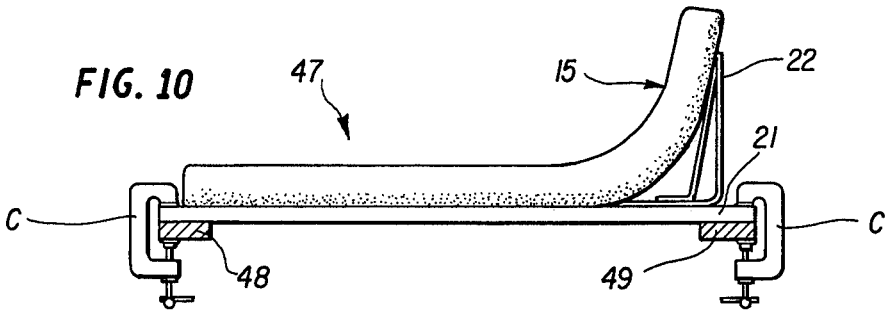
FIG. 11
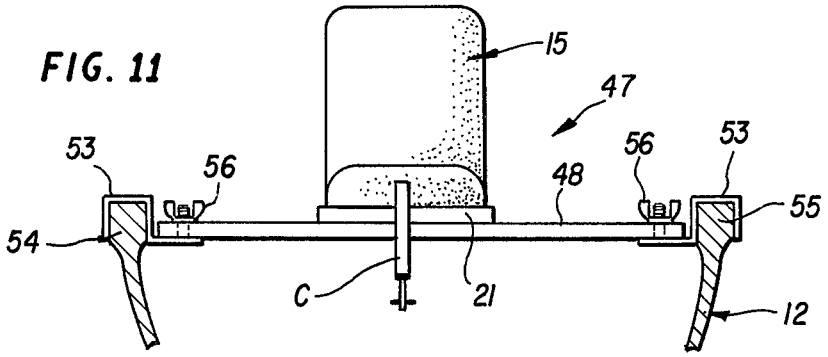

CANOE SEAT CONSTRUCTION

BACKGROUND OF THE INVENTION

1. Field of the Invention

This invention relates generally to canoes and more particularly relates to a seat construction for canoes in which the seat may be readily adjusted to different positions to accommodate different paddlers. Further, the seat construction enables the seat to be readily positioned for optimum weight distribution of the paddler or paddlers in the canoe and moreover, enables the paddler to position himself for maximum effectiveness in paddling the canoe. More specifically, the seat construction enables the seat or seats to be positioned near the middle of the canoe such that either a single paddler or multiple paddlers, as the case may be, are positioned near the middle of the canoe to improve planing of the canoe on the water and also to position the paddler near the side of the canoe at the widest point of the canoe whereby maximum strength of the paddler can be utilized in the paddling action to thus improve paddling efficiency. The seat construction of the invention also enables the seats and associated frame to be removed from one canoe and placed on another canoe.

2. Description of the Prior Art

Various adjustable seat constructions are known in the prior art for increasing the comfort of the user and for facilitating weight distribution in the boat.

Examples of some prior art seat constructions are disclosed in U.S. Pat. Nos. 149,913; 294,029; 2,299,178; 2,836,223 and 3,718,365. However, some of the seat constructions disclosed in these patents are movable only in one or the other of the transverse and longitudinal directions of the boat and other seat constructions are secured to the existing seats in the boat, thus limiting the positioning of the seats. Moreover, the seat construction shown in some of these patents are relatively complex and heavy and are not readily movable from one boat to the other. Additionally, none of the seat constructions shown in these patents relates to a canoe and wherein the object of the adjustable seat construction and the structure thereof is to improve planing of the canoe on the water and to position the paddler for maximum effectiveness in paddling the canoe. In other words, none of these patents recognized the particular problem recognized by Applicant and solved by his structure.

SUMMARY OF THE INVENTION

Accordingly, it is an object of this invention to provide a seat construction for a canoe in which the seat is readily adjustable to different positions in the canoe for achieving optimum weight distribution in the canoe to improve planing of the canoe on the water and to position the paddler for most efficient paddling.

Another object of the invention is to provide a canoe seat construction wherein the seat is readily adjustable to different positions in the canoe and is removable from the canoe for placement in different canoes, and which provide support to a paddler such that the paddler can effectively utilize maximum strength for paddling the canoe.

A more specific object of the invention is to provide a canoe seat construction for at least two paddlers wherein a seat for each paddler is adjustably supported near the center of the canoe to thus improve weight distribution in the canoe and maximize or enhance the planing action of the canoe on the water and position the paddlers for maximum effectiveness in paddling the canoe.

These and other objects of the invention are obtained by the provision of a light weight adjustable seat construction for the canoe in which a subframe is mounted to the gunwales of the canoe and a seat frame is carried by the subframe for movement transversely of the canoe. A seat is carried by the seat frame for movement longitudinally of the canoe and the seat or seats may be quickly and easily positioned in an optimum location for a particular rider to maximize paddling effectiveness of that rider and to achieve optimum weight distribution of the rider or riders in the canoe.

BRIEF DESCRIPTION OF THE DRAWINGS

Various other objects, features and attendant advantages of the present invention will be more readily appreciated as the same becomes better understood from the following detailed description when considered in connection with the accompanying drawings in which like reference characters designate like or corresponding parts throughout the several views, and wherein:

FIG. 9 is a exploded perspective view of a modified subframe assembly for use with an alternate construction of a seat;

FIG. 10 is a side view in elevation with portions in section of an alternate seat construction attached to the subframe of FIG. 9;

FIG. 11 is a front view in elevation with portions in section of the seat and subframe assembly of FIGS. 9 and 10;

DETAILED DESCRIPTION OF THE PREFERRED EMBODIMENTS

Figure 1:
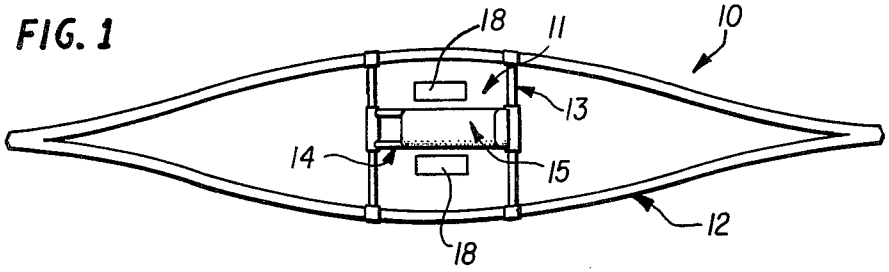
FIG. 1 is a plan view of a first form of the invention wherein a single seat is provided for supporting a single paddler in the canoe.
Figure 2:
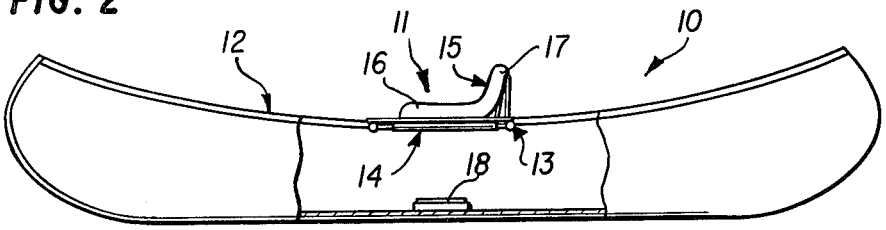
FIG. 2 is a view in side elevation with a portion shown in section, of the canoe of FIG. 1.

A single seat version of the invention is indicated generally at 10 in FIGS. 1 and 2 and comprises a single seat 11 mounted at substantially the middle of the canoe 12. The seat construction 11 comprises a subframe 13, a seat frame 14 and the seat 15. The seat is generally saddle shaped and includes a bottom 16 and a back rest 17. A pair of knee braces 18 are mounted on the bottom of the canoe and when a single paddler straddles the seat 15 his knees are supported on the knee braces 18. The shape and position of the seat 15 provides superior comfort and support to the paddler and enables him to exert maximum strength in his paddling efforts. Moreover, adjustments of the position of the seat 15 may be easily made to suit the particular needs or desires of the particular paddler.

Figure 3:
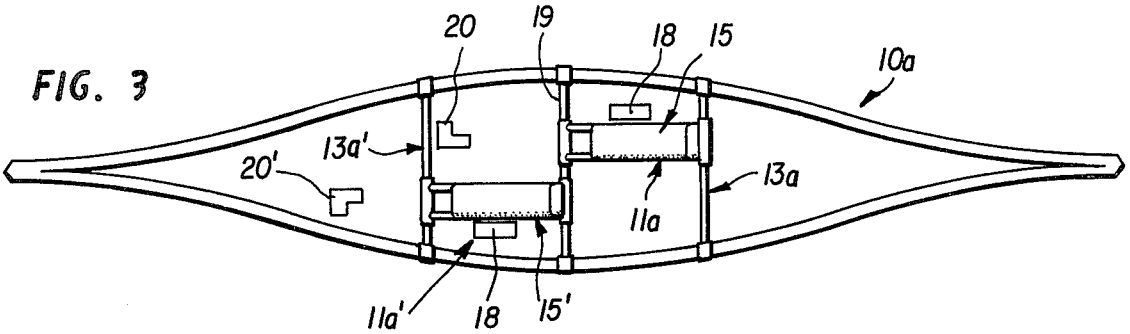
FIG. 3 is a plan view of a canoe showing two seats positioned in the canoe in accordance with the invention.

A double seat construction is indicated generally at 10*a* in FIG. 3 and is similar to the single seat arrangement except two seat assemblies 11*a* and 11*a'* are provided with adjacent ends of the seat assemblies supported on a common center brace 19 extending transversely of the canoe at its mid portion. The center brace 19 thus comprises a part of the subframe assemblies 13*a* and 13*a'* which supports the seat frames 14*a* and 14*a'* from which the seats 15 and 15' are mounted. As in the previous form of the invention, a knee brace 18 is provided adjacent the side of each seat 15, 15' between the respective seats and the adjacent side of the canoe on which the knee of a paddler supported on each seat may be rested. Foot braces 20 and 20' are also mounted on the bottom of the canoe at positions spaced forwardly of the respective seats 15 and 15' for bracing the foot of the respective paddlers. With this arrangement it will be seen that the weight of the paddlers is concentrated at the center of the canoe so that planing of the canoe on the water is improved. Also, the seat construction provides superior support to the paddler as noted in connection with FIGS. 1 and 2.

Figure 4:
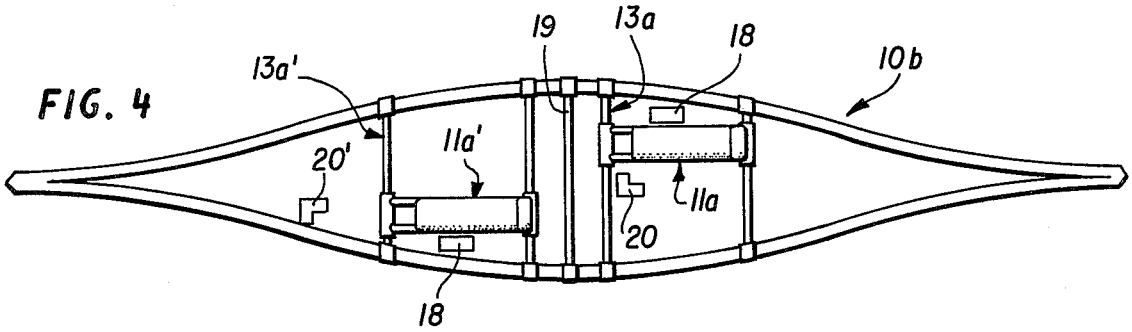
FIG. 4 is a plan view similar to FIG. 3 showing another arrangement of two seats in a canoe in accordance with the invention.
Figure 5:
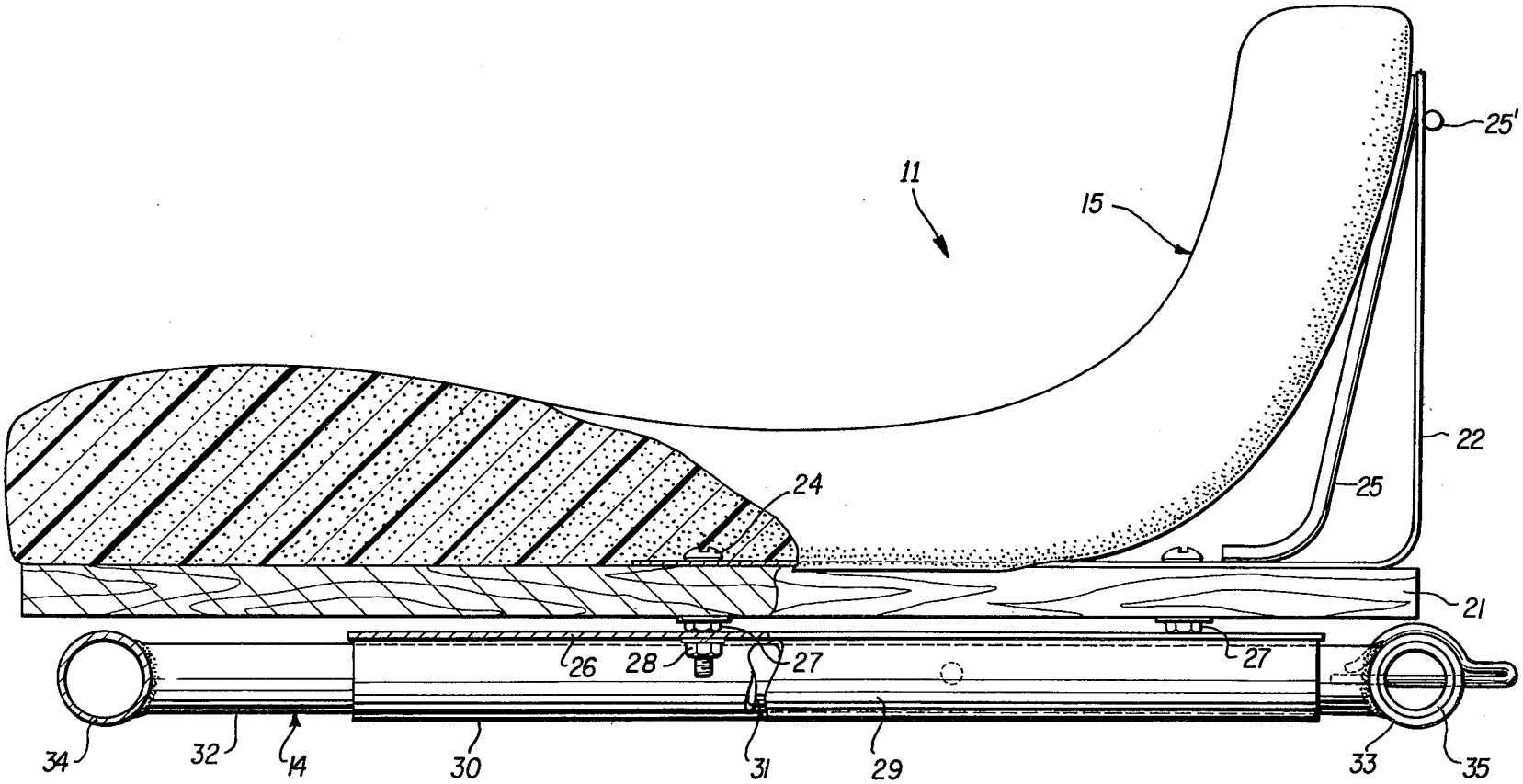
FIG. 5 is a greatly enlarged side view with portions shown in section of a preferred seat construction according to the invention.
Figure 7:
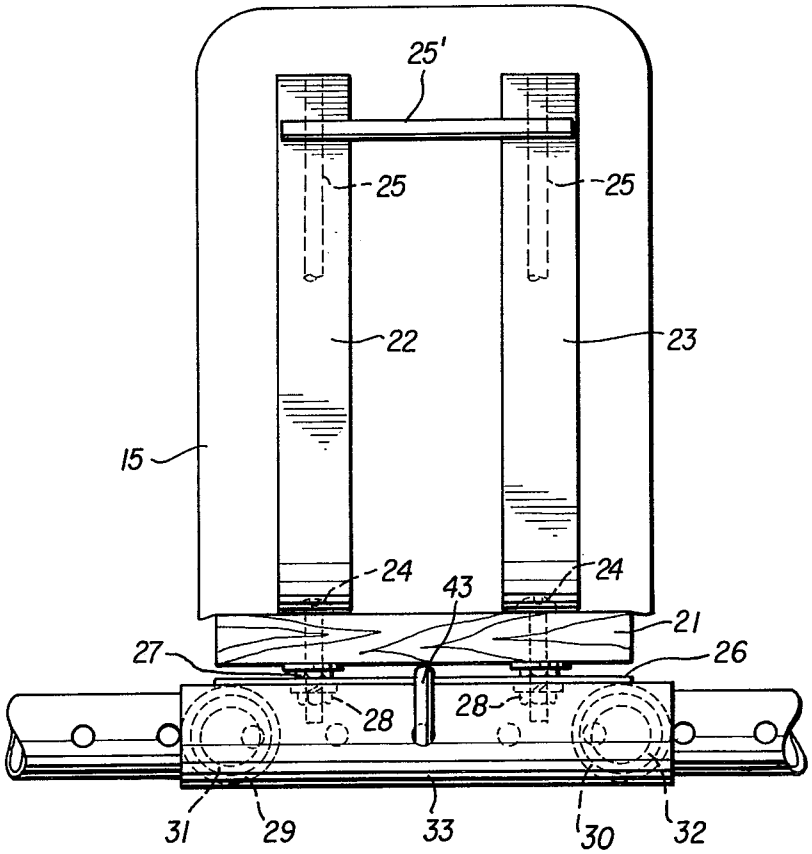
FIG. 7 is a rear view in elevation of the seat construction of FIG. 5.
Figure 6:
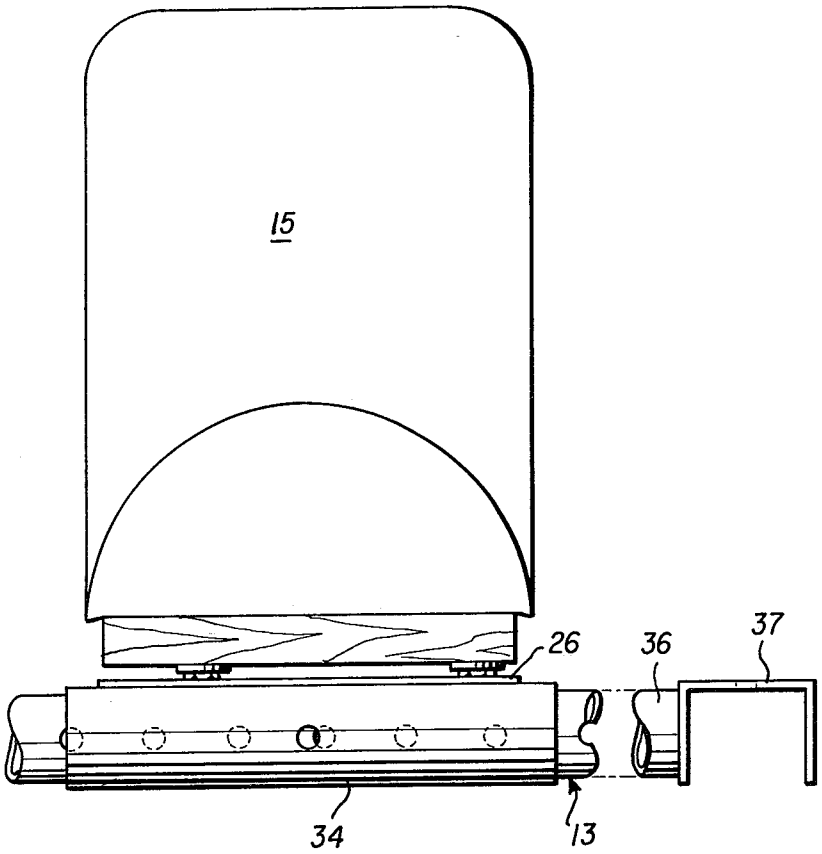
FIG. 6 is a front view in elevation of the seat construction of FIG. 5.
Figure 8:
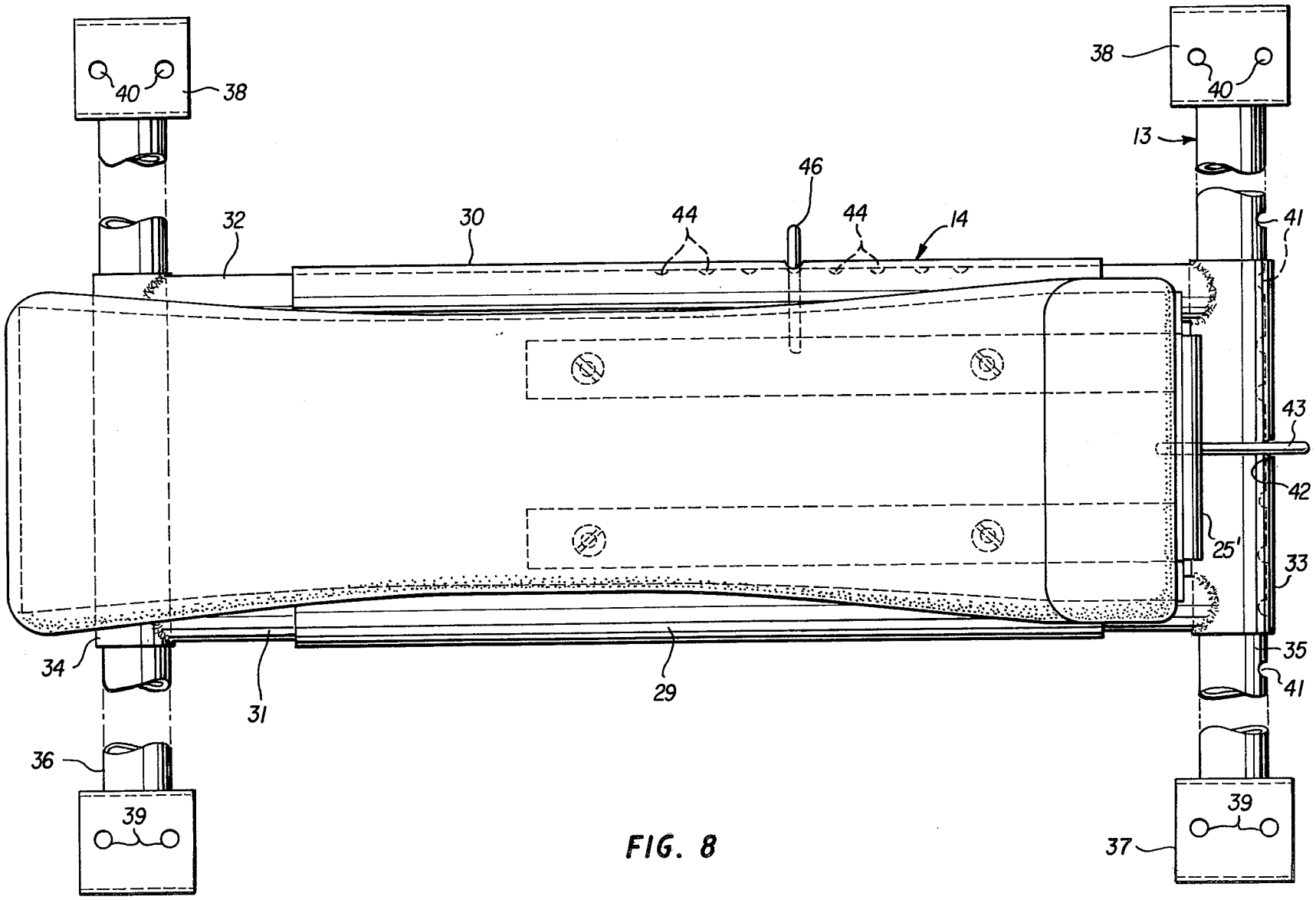
FIG. 8 is a plan view of the seat construction of FIG. 5.

A variation of the double seat arrangement of FIG. 3 is indicated generally at 10*b* in FIG. 4 and is substantially identical to the form of the invention shown in FIG. 3 except that the subframe assemblies 13*a* and 13*a'* each comprise separate cross frame members arranged on opposite longitudinal sides of the center brace 19 rather than incorporating the center brace as in FIG. 3. However, the same advantages in seat assembly constructions apply in this form as well as in the previous forms.

Details of construction of the preferred form of seat assembly are shown in FIGS. 5, 6, 7 and 8, wherein the seat construction 11 includes a rectangular shaped base 21 of wood or other suitable material having a pair of angle brackets or braces 22 and 23 secured to the upper surface thereof by means of screws or bolts or the like 24 such that one leg of the brackets 22 and 23 extends upwardly substantially perpendicular from the base 21. A brace 25 extends between that portion of the brackets 22 and 23 which lies on top of the base 21 and the uppermost end of the upwardly projecting portion of the bracket. The brackets 22 and 23 could be suitably reinforced with other means if necessary such as integral reinforcement as used in steel shelf brackets and the like.

The seat 15 comprises a shaped foam member suitably contoured to provide comfort and support to the paddler and is affixed to the base 21 in any suitable manner such as by the use of glue or cement and the like. Examples of suitable materials are polystyrene, Kevlar, fiberglass, etc..

The seat frame also includes a rectangularly shaped metal plate 26 held in spaced relation below the base 21 by means of the screws 24, which project downwardly beyond the lower surface of the base 21. First nuts 27 are threaded onto the screws or bolts 24 for securing the brackets 22 and 23 to the base and second nuts 28 are threaded onto the screws or bolts 24 for securing the plate 26 to the base 21.

A pair of longitudinally extending tubes 29 and 30 are welded to the underside of the plate 26 along the opposite edges thereof and these tubes are slidably mounted on a second pair of tubes 31 and 32 which are suitably secured as by welding or the like at their opposite ends to a pair of transversely extending tubes 33 and 34. The tubes 33 and 34 are, in turn, slidably mounted on a further pair of transversely extending tubes 35 and 36, each of which has a pair of channel shaped brackets or mounting plates 37 and 38 suitably fixed to its opposite ends as by welding or the like. Each mounting bracket has a plurality of mounting holes 39 and 40 therethrough for securing the brackets to the gunwales of the canoe.

The tubes 29, 30, 31, 32, 33 and 34 comprise the seat frame 14, whereas the tubes 35 and 36 with brackets 37 and 38 comprise the subframe 13. All of the frame components including the tubes and brackets may be made from any suitable material such as aluminum or the like.

For securing the seat in adjusted positions transversely of the canoe the tube 35 has a plurality of holes 41 formed in equally spaced apart relationship along one side thereof and the tube 33 of the seat frame 14 has a hole 42 adapted to be placed in aligned registry with one of the holes 41 for receipt of a retaining pin 43 therethrough to hold the seat in adjusted position along the tubes 35 and 36. Similarly, the tube 32 has a plurality of holes 44 spaced along one side thereof and the tube 30 has a hole 45 adapted to be placed in aligned registry therewith for receipt of a locking pin 46 therethrough to hold the seat in adjusted position longitudinally of the tubes 31 and 32 and thus of the canoe. Finger screws and nuts can be used rather than pins 43, 46, if desired.

The entire seat and frame assembly is readily releasably attached to the gunwales of the canoe by means of screws or other suitable fasteners extended through the openings 39 and 40 and the brackets 37 and 38 and into the gunwales of the canoe. Thus, the seat assembly may be readily removed from one canoe and positioned in another for use as desired.

A modified seat construction is indicated generally at 47 in FIGS. 9, 10 and 11 and comprises a pair of cross frame members 48 and 49 formed of wood or other suitable material and having holes 50, 51 formed through the opposite ends thereof for reception of upstanding stud bolts 52 on suitable brackets 53 secured to the gunwales 54 and 55 of the canoe 12. Wing nuts or other suitable fasteners 56 are adapted to be threaded upon the bolts 52 for securing the cross frame members 48 and 49 to the brackets 53. The brackets 53 may be secured to the gunwales 54 and 55 in any suitable manner, such as by the use of screws or the like extended downwardly through the brackets into the gunwales, or by the use of C-clamps and the like.

The seat 15 is secured to the cross frame members 48 and 49 by clamping the base 21 to the upper surfaces of the cross frame members 48 and 49 by the use of C-clamps C or the like.

Figure 12:
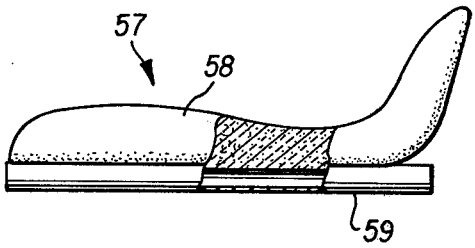
FIG. 12 is a side view in elevation of a second modification of a seat in accordance with the invention.
Figure 13:
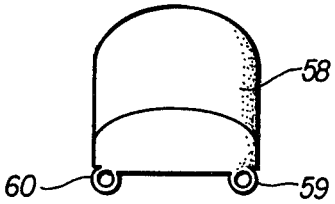
FIG. 13 is a front view in elevation of the seat of FIG. 12.
Figure 14:
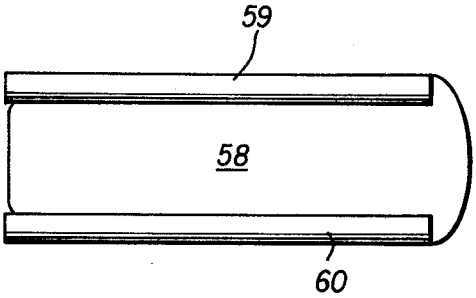
FIG. 14 is a bottom view of the seat construction of FIG. 12.

A further modification of the invention is indicated generally at 57 in FIGS. 12, 13 and 14, wherein the seat 58 is molded from fiberglass or like material with tubes 59 and 60 integrally attached to the underside thereof. The tubes 59 and 60 could then be slidably mounted upon a frame assembly such as illustrated and described in FIGS. 5–8.

Figure 15:
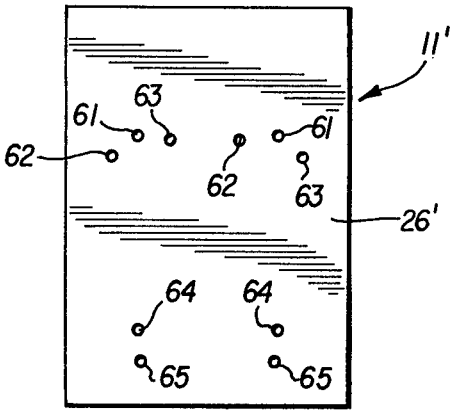
FIG. 15 is a plan view of a mounting plate for the seat, showing holes arranged for pivotal adjustment of the seat.
Figure 16:
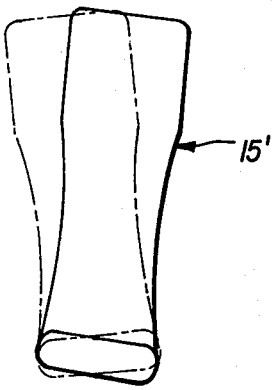
FIG. 16 is a plan view of a seat showing the seat in full line adjusted or pivoted to the right, and in dot-and-dash line adjusted to the left.

In FIGS. 15 and 16 a seat and frame arrangement are indicated at 11', wherein a plurality of holes 61, 62, 63 and 64, 65 are provided in the plate 26' for pivotal, side-to-side adjustment of the front of the canoe seat 15'. In other words, the bolts 24 would be disposed through holes 61 and 64 for normal, straight ahead positioning of the seat, but the additional holes 62 or 63 and 65 are arranged on arcs whereby, for example, one of the bolts at the rear of the seat, in one of the holes 64, could be removed and the bolts in holes 61 removed, whereafter the seat would be pivoted either right or left, depending on which of the bolts was removed at the rear of the canoe, and the bolts 24 at the front of the canoe then placed in the appropriate holes 62 or 63. Likewise, the bolt removed at the rear of the seat would be placed in the appropriate hole 65. Moreover, the seat 15' is flared slightly at the front to provide a wider support for the leg of the paddler. This arrangement, i.e. the adjustment holes and the flared seat, enables better balance and power to be achieved by the paddler, since his body need not be twisted during paddling to the same extent it would be if the seat were straight ahead.

Figure 17:
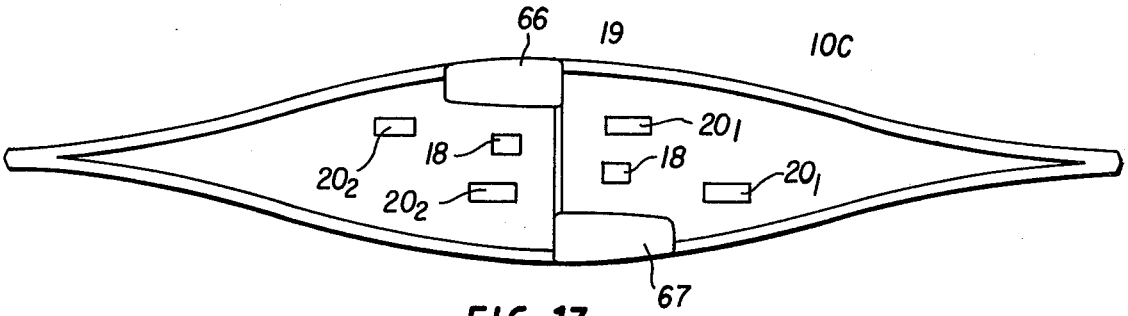
FIG. 17 is a plan view of a canoe showing an alternate arrangement of seats and knee and foot support for enabling the canoe to be paddled in either direction without relocating the seats or supports.

A still further modification is indicated generally at 10*c* in FIG. 17 and in this form of the invention a pair of seats 66 and 67 are supported at opposite sides of the canoe 12 at the center brace 19 and a knee brace 18 is associated with each seat 66 and 67. A pair of foot braces $20_1$ and $20_2$ are associated with each seat 66 and 67 spaced longitudinally of the canoe from opposite ends of the seats, whereby a paddler can merely turn around and face an opposite direction to paddle the canoe in the opposite direction. In this form of the invention, the seats 66 and 67 would not have backs as in the previously described forms of the invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A canoe seat construction, comprising:
a canoe having gunwales;
a subframe extending across the width of the canoe and removably mounted on the gunwales of the canoe wherein the subframe includes a canoe center brace extending transversely of the canoe at the center thereof;
a seat frame adjustably movably supported on the subframe for movement transversely of the canoe;
a contoured seat adjustably movably carried by the seat frame for movement longitudinally of the canoe wherein a plurality of seats are provided, including at least one on each side of the center brace, with adjacent ends of the seats supported on the center brace; and
fastening means for releasably securing the seat frame and seat against movement in their adjusted positions, said seat being supported near the center of the canoe to concentrate weight near the center of the canoe and enhance planing of the canoe on the water and also to position a paddler for maximum effectiveness in paddling.

2. A canoe seat construction as in claim 1, wherein:
the plurality of seats are supported on the canoe, said seats being spaced substantially equally relative to the center of the canoe, on opposite sides thereof, and near the center to concentrate weight at the center of the canoe to enhance planing of the canoe on water, one of said seats being positioned near one side of the canoe and the other seat being positioned near the other side, whereby paddlers sitting on the respective seats are positioned for maximum paddling effectiveness.

3. A canoe seat construction as in claim 2, wherein:
a knee brace is mounted on the bottom of the canoe adjacent the side of each seat, between the seat and most closely adjacent side of the canoe; and
a foot brace is mounted on the bottom of the canoe spaced fowardly of each seat for supporting and bracing the foot of a paddler sitting on the respective seat.

4. A canoe seat construction as in claim 1 or 2 or 3, wherein:
the subframe, seat frame, and seat are made of light weight materials.

5. A canoe seat construction as in claim 4, wherein:
the subframe and seat frame are made of aluminum tubing; and
the seat is molded of foam material.

6. A canoe seat construction as in claim 4, wherein:
the subframe and seat frame are made of aluminum tubing; and
the seat is molded fiberglass.

7. A canoe seat construction as in claim 5, wherein:
the subframe for each seat comprises a pair of parallel, spaced apart aluminum tubes extending transversely across the width of the canoe and supported at their opposite ends on the gunwales of the canoe;
the seat frame comprises a first pair of parallel, spaced apart aluminum tubes extending longitudinally of the canoe, and a second pair of parallel aluminum tubes fixed to the opposite ends of the first pair of tubes, said second pair of tubes being slidably mounted on the subframe tubes; and
the seat has a pair of parallel aluminum tubes at opposite edges thereof slidably mounted on the first pair of tubes of the seat frame.

8. A canoe seat construction as in claim 7, wherein:
the seat further comprises a rectangular wooden base, on a bottom surface of which the seat tubes are fixed, and on a top surface of which the contoured, molded foam seat is fixed.

* * * * *

UNITED STATES PATENT AND TRADEMARK OFFICE

CERTIFICATE OF CORRECTION

PATENT NO. : 4,357,894

DATED : November 9, 1982

INVENTOR(S) : Johnny Kirk

It is certified that error appears in the above-identified patent and that said Letters Patent is hereby corrected as shown below:

Column 2, line 45 delete "a" and substitute --an--.

Column 3, line 56, delete "rectangular" and substitute --rectangularly--.

Signed and Sealed this

*Twenty-second* Day of *February 1983*

[SEAL]

*Attest:*

GERALD J. MOSSINGHOFF

*Attesting Officer*

*Commissioner of Patents and Trademarks*